US005748090A

United States Patent [19]

Borg et al.

[11] Patent Number: 5,748,090

[45] Date of Patent: May 5, 1998

[54] OPTICAL FLAMEOUT DETECTOR

[75] Inventors: Stephen E. Borg, Norfolk; James W. West; Robert M. Lawrence, both of Hampton; Samuel E. Harper, Jr.; David W. Alderfer, both of Newport News, all of Va.

[73] Assignee: The United States of America as represented by the Administrator of the National Aeronautics and Space Administration, Washington, D.C.

[21] Appl. No.: 892,833

[22] Filed: Jul. 16, 1997

Related U.S. Application Data

[63] Continuation of Ser. No. 518,853, Aug. 24, 1995, abandoned, which is a continuation of Ser. No. 141,294, Oct. 19, 1993, abandoned.

[51] Int. Cl.[6] ..... G08B 17/12

[52] U.S. Cl. ..... 340/578; 250/372; 250/227.11

[58] Field of Search ..... 340/578; 250/372, 250/395, 554, 227.11, 227.29

[56] References Cited

U.S. PATENT DOCUMENTS

| | | | |
|---|---|---|---|
| 3,653,016 | 3/1972 | Cormier | 340/521 |
| 4,709,155 | 11/1987 | Yamaguchi et al. | 340/578 |
| 4,882,573 | 11/1989 | Leonard et al. | 340/578 |
| 4,904,986 | 2/1990 | Pinckaers | 340/578 |
| 4,988,884 | 1/1991 | Dunbar et al. | 340/578 |
| 5,191,220 | 3/1993 | Innes | 340/578 |
| 5,317,165 | 5/1994 | Montagna | 340/578 |

*Primary Examiner*—Jeffery Hofsass
*Assistant Examiner*—Benjamin C. Lee
*Attorney, Agent, or Firm*—Kimberly A. Crasteen

[57] ABSTRACT

A device has been developed which monitors the presence of a flame within a combustion chamber. The optical flameout detection system responds to gross changes in combustor light intensity, which is monitored in two spectral bands. A photomultiplier tube makes optical measurements in the ultraviolet portion of the spectrum, and a silicon photodiode covers the visible region. The detectors, located outside the combustion chamber, receive the light energy radiated from the combustion process through fiber optic probes designed to operate in a high pressure environment. The optical fibers are aimed diagonally through the center of the injector at the combustion chamber wall downstream of the injector. The probed observe events occurring within a narrow conical-shaped field of view so that the system can quickly detect longitudinal movement of the flame front away from the injector. If a change in intensity of the flame is detected, the fuel supply to the combustion chamber is shut off, limiting the amount of unburned fuel in the combustion chamber which could reignite.

5 Claims, 4 Drawing Sheets

OPTICAL FLAMEOUT DETECTOR

This is a continuation of application Ser. No. 08/518,853 filed on Aug. 24, 1995 now abandoned which is a continuation of application Ser. No. 08/141,294 filed on Oct. 19, 1993., now both abandoned.

ORIGIN OF THE INVENTION

The invention described herein was jointly made in the performance of work under a NASA contract and by employees of the United States Government and is subject to the provisions of Section 305 of the National Aeronautics and Space Act of 1958, as amended, Public Law 85-568 (72 Stat. 435; 42 U.S.C. 2457).

BACKGROUND OF THE INVENTION

1. Technical Field of the Invention

The present invention relates generally to flameout detectors for monitoring the presence of a flame and more particularly to an opticalbased flameout detector.

2. Discussion of the Related Art

Flameout detection systems are well known in the art. It is necessary to detect a flameout to guard against an unplanned combustor flameout and reignition during operation. By detecting the flameout quickly and limiting the quantity of fuel allowed to enter the combustion chamber after a flameout is detected, the magnitude of a detonation is limited to acceptable levels if a reignition of the unburned fuel occurs. Present flameout detectors include optical systems and temperature sensing devices. The optical devices are ultraviolet detectors which sense UV radiation generated by combustion in the 200–300 nm range such as Geiger-Mueller or Edison tubes which provide response times of 150 milliseconds to 30 seconds. The temperature sensing devices include thermocouples which are immersed in the flame to sense the flame temperature. These devices provide response times of 200–300 milliseconds. In addition to having slow response times, these systems are unable to survive the high pressures and widely varying temperatures within some combustor environments.

It is accordingly an object of the present invention to provide an optical flameout detector having a response time less than 100 milliseconds.

It is a further object of the present invention to provide an optical flameout detector able to withstand pressures up to 28 MPa (4000 psi).

It is an additional object of the present invention to provide an optical flameout detector able to withstand temperatures up to 1700° C. (3100° F.)

It is yet another object of the present invention to accomplish the foregoing objects in a simple manner.

Additional objects and advantages of the present invention are apparent from the drawings and specification that follow.

SUMMARY OF THE INVENTION

A device for detecting a flameout in a fuel-supplied combustion chamber is provided which includes a pair of optical detectors optically coupled to a pair of fiber optic probes. The ultraviolet optical detector, preferably a photomultiplier tube, provides a measurement of the change in intensity of a flame within the ultraviolet region of the light spectrum. The visible light optical detector, preferably a silicon photodiode, provides a measurement of the change in intensity of a flame within the visible region of the light spectrum. The fiber optic probes have a field of view between 0° and 16° and are located within the combustion chamber to couple each optical detector to the light source. In the preferred embodiment, the fiber optic probes are fused silica optical fibers encased in a stainless steel sheath and an epoxy resin is inserted in between the optical fiber and the steel sheath at one end and a silicon RTV (room temperature vulcanizer) is inserted in between the optical fiber and the steel sheath at the other end. The measurements taken by the optical detectors are evaluated to determine if a change in intensity has occurred within the flame and, if a change has occurred, a signal is provided indicating a flameout.

DETAILED DESCRIPTION OF THE INVENTION

Figure 1:
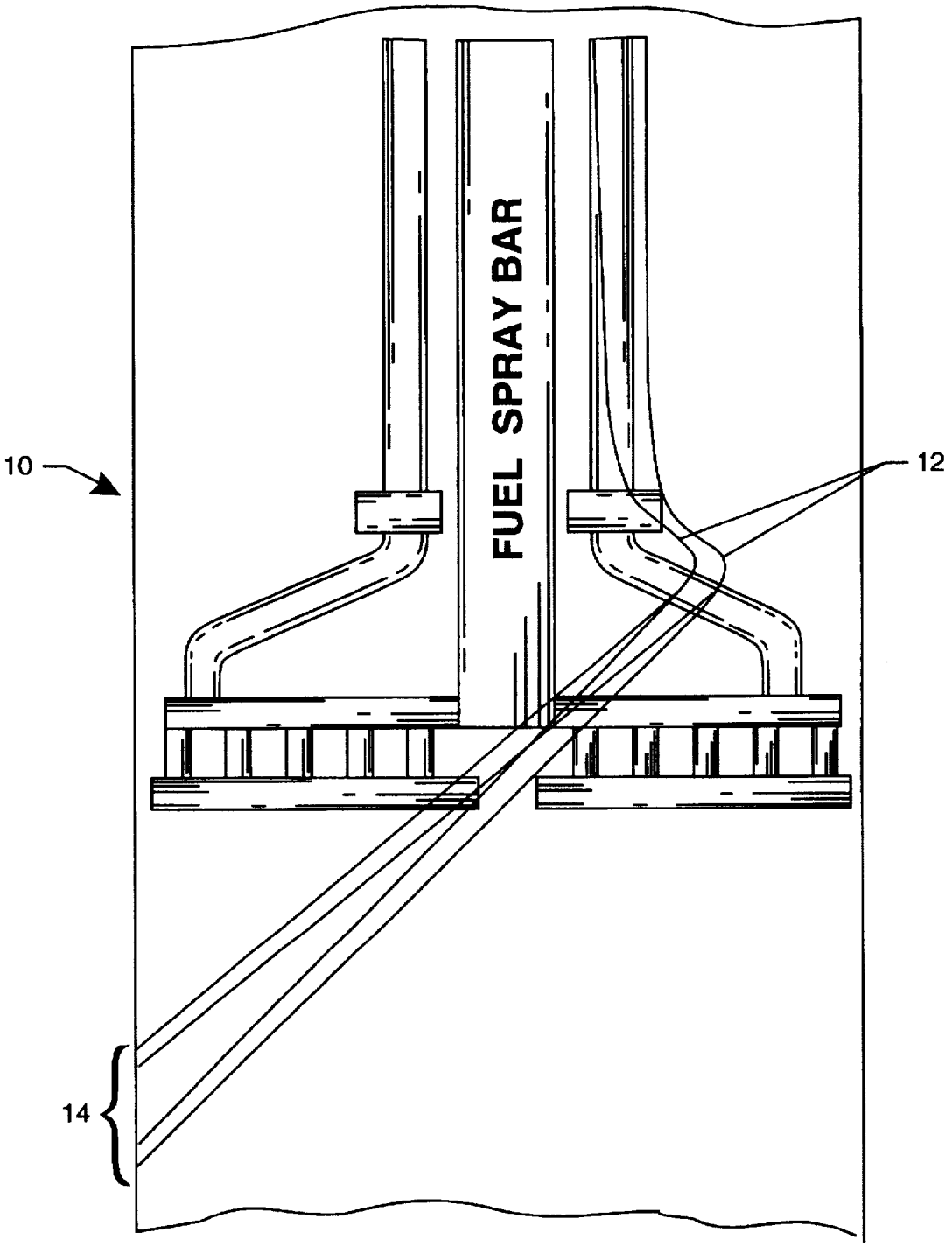
FIG. 1 is a view of the interior of the combustion chamber.
Figure 2:
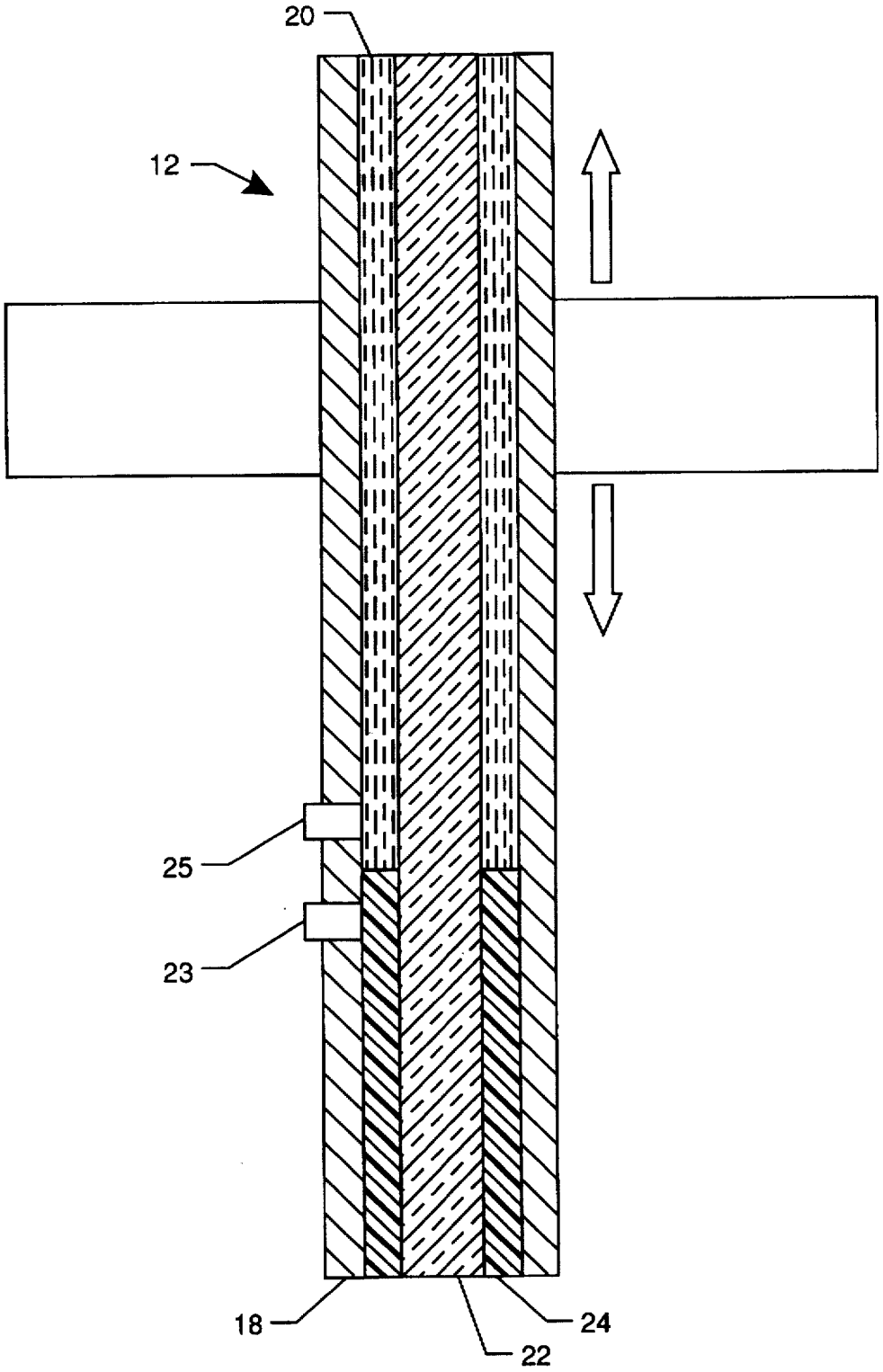
FIG. 2 is a cross-sectional view of the fiber optic probe.
Figure 3:
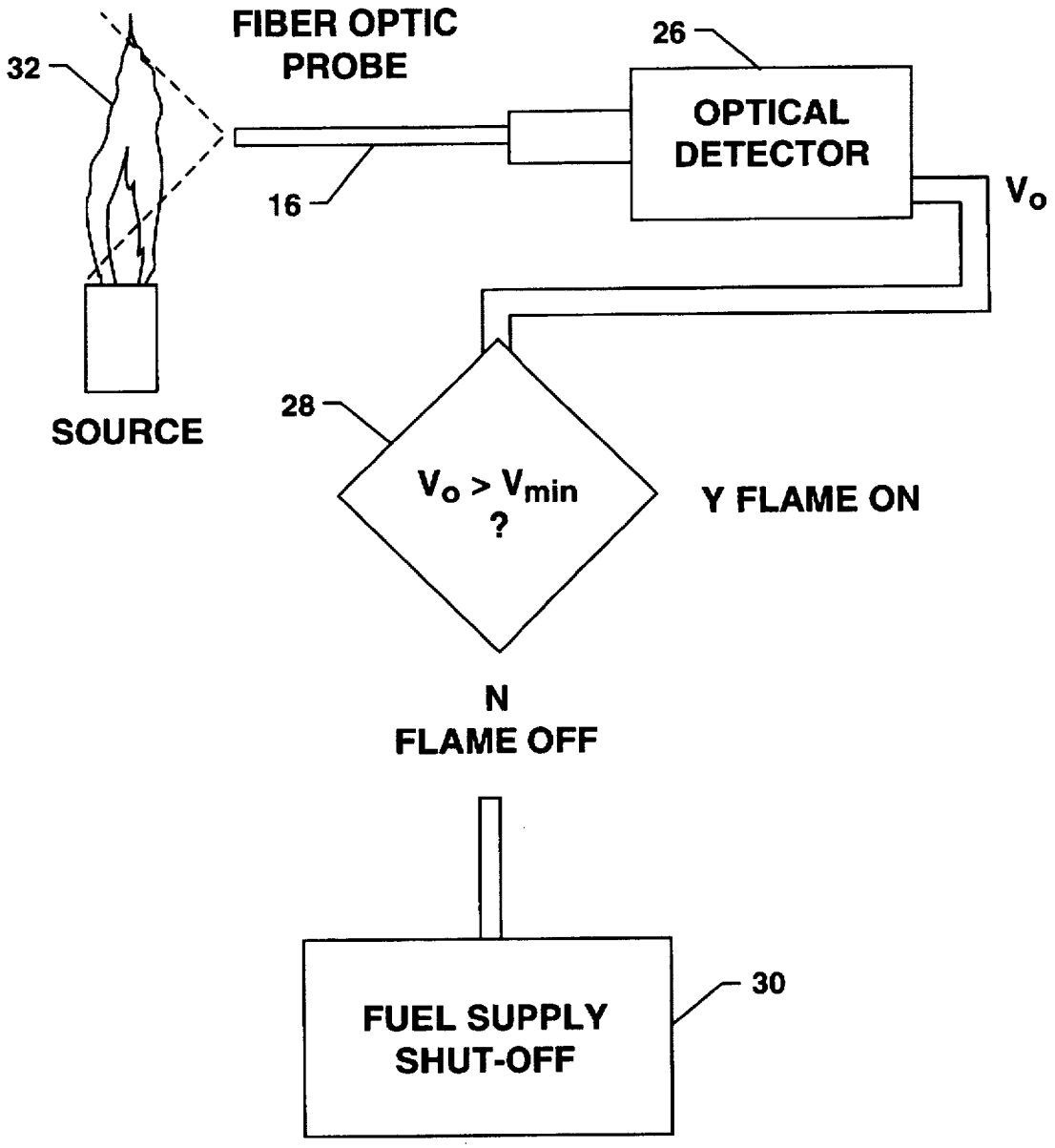
FIG. 3 is a block diagram of the optical flameout detector.
Figure 4:
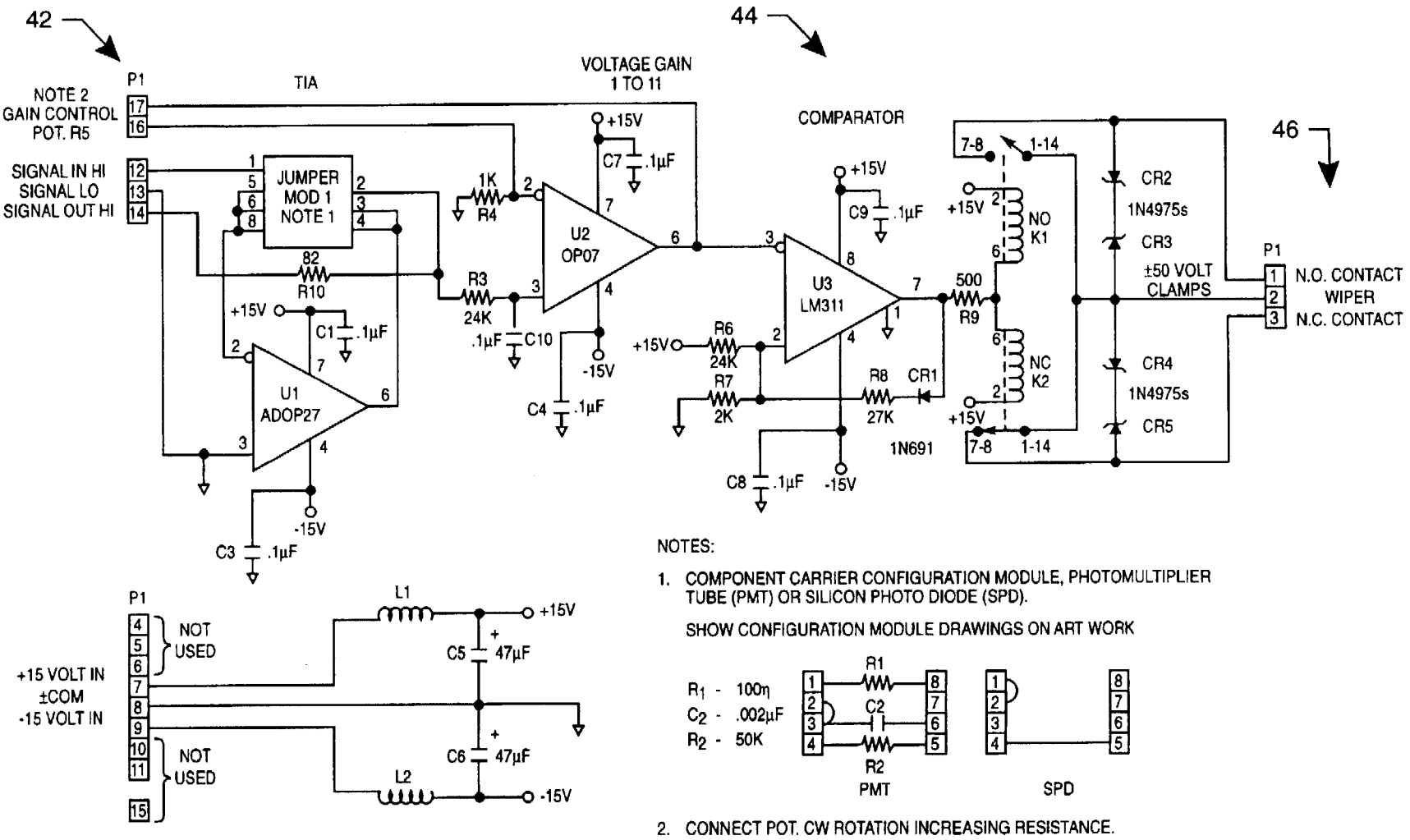
FIG. 4 is a circuit diagram of the flame detection circuitry.

A unique device for detecting flameouts is described in detail below. The device is generally applicable to any combustion chamber or furnace in which a flameout followed by reignition of unburned fuel could cause catastrophic damage. This device optically detects if a flameout has occurred, and, if so, shuts down the main fuel supply to the combustion chamber or furnace, limiting the amount of unburned fuel which would collect in the combustion chamber after normal combustion has stopped. By limiting the quantity of unburned fuel to below the flammable limit, a reignition, deflagration and detonation are not possible.

The optical flameout detection system is designed to respond to gross changes in combustor light levels. Light intensity is monitored in two spectral bands by two independent optical detectors 26. A photomultiplier tube makes optical measurements in the ultraviolet portion of the spectrum from 200–600 nm, and a silicon photodiode covers the visible region from 400–1100 nm.

The optical detectors 26 are located outside the combustion chamber 10 and are optically coupled to the light energy radiated from air/methane combustion with two fiber optic probes 12. The fiber optic probes 12 are 6 m (20 ft.) in length and are designed specifically for operation in the high pressure (28 MPa, 4000 psi) oxidizing environment within the combustion chamber 10. They are comprised of a single, 690 micron diameter, fused silica optical fiber 22 encased in a one-sixteenth (0.062) inch diameter stainless steel sheath 18. A standard grade, two part epoxy resin 24 cured with Di-n-Butyl Phthalate is inserted through fill hole 23 of steel sheath 18. An optically transparent liquid silicon 20 (GE Silicones Part number 655) is inserted between the optical fiber 22 and the steel sheath 18 through fill hole 25. The silicon has the following properties: a temperature range from 500° F. to −166° F., specific gravity of 1, thermal coefficient of expansion of $33.0\times10^{-5}$ cm/cm°C., index of refraction of 1.435 and thermal conductivity of 0.11 Btu/hr·ft$^2$·°F/ft. The fiber optic probes 12 are aimed to look transversely across the flow of gases at a region of the combustion chamber 10 wall roughly 15 inches in front of the spray bar. The fiber optic probes 12 do not have focussing optics, and are able to see events occurring within a 16 degree conical field-of-view. Selection of this optical path permits the detection system to respond quicker to a potential flameout by being able to see movement of the flame front 32 down the combustion chamber 10 as the flame 32 leaves the direct field-of-view 14. This limited field-of-view 14 allows the system to react much more quickly in detecting a flameout as compared to other detector systems having a 180° field-of-view. If the flame 32 leaves the limited field of view 14, a flameout is detected.

The detector outputs are conditioned and used to activate a logic circuit which determines whether a flame ON/OFF condition exists within the combustion chamber 10. Characterizing the detection system's 28 response to the various combustor light levels associated with different flame intensities—pilot, boost, and main-flame—was achieved through experimentation. In order to generate a main-flame "ON" indication from the detection circuitry, the detector outputs must exceed a preset minimum value corresponding to a low level boost flame. Once this voltage level is reached, a FLAME ON condition is signalled to the facility control system. Conversely, if the detector outputs drop beneath a minimum value, then a FLAME OFF condition is realized. A FLAME OFF signal from the detection system 28 will be used to initiate a rapid shut down of the main fuel supply by the facility control system 30.

The basis of the flame detection circuitry is a non-inverting amplifier 42, a voltage comparator 44, and two relays 46—one normally open (NO), and one normally closed (NC). The amplifier conditions the output from the detector for the fixed voltage comparator. Variation of the amplifier gain will change the minimum detector output voltage required to generate a state change in the fixed voltage level comparator. A 2-1 comparator turn ON/OFF voltage ratio has been designed into the comparator circuitry to guard against false triggers from reflections within the combustion chamber 10. When a change in state of the comparator does occur, a corresponding change in state of the NO/NC relay combination will also take place. The relay combination is the flameout detection system's trigger that will be monitored directly by the facility's control system 30. Design of the comparator/relay combination will insure that a "FLAME OFF" signal is generated in the event of a power/component failure.

Although our invention has been illustrated and described with reference to the preferred embodiment thereof, we wish to have it understood that it is in no way limited to the details of such embodiment, but is capable of numerous modifications for many mechanisms, and is capable of numerous modifications within the scope of the appended claims.

We claim:

1. A device for detecting a flameout in a fuel-supplied combustion chamber, comprising:

an ultraviolet optical detector providing a measurement of the change in intensity of a flame within the ultraviolet region of the light spectrum;

a visible light optical detector providing a measurement of the change in intensity of a flame within the visible region of the light spectrum;

a pair of fiber optic probes having a field of view between 0° and 16°, each fiber optic probe having approximately the same field of view, located within the combustion chamber to respectively couple each optical detector to the light source;

an evaluating means for evaluating the measurements provided by the optical detectors; and a signal providing means for providing a FLAME OFF signal when the evaluating means determines that a flameout has occurred.

2. The device according to claim 1 wherein the ultraviolet optical detector is a photomultiplier tube.

3. The device according to claim 1 wherein the visible light optical detector is a silicon photodiode.

4. The device according to claim 1 wherein the fiber optic probes are fused silica optical fibers encased in a steel sheath.

5. The device according to claim 4 further including an epoxy resin inserted at a first end of the optical fiber between the optical fiber and the steel sheath and a silicon RTV inserted at a second end of the optical fiber between the optical fiber and the steel sheath.

* * * * *